US011730236B2

(12) United States Patent
Chen

(10) Patent No.: US 11,730,236 B2
(45) Date of Patent: Aug. 22, 2023

(54) FASTENING DEVICE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 0 days.

(21) Appl. No.: 17/334,796

(22) Filed: May 31, 2021

(65) Prior Publication Data

US 2021/0282503 A1 Sep. 16, 2021

Related U.S. Application Data

(63) Continuation of application No. 16/550,274, filed on Aug. 25, 2019, now Pat. No. 11,064,767.

(30) Foreign Application Priority Data

Oct. 30, 2018 (TW) ..... 107138414
Jul. 1, 2019 (TW) ..... 108123146

(51) Int. Cl.
*A43C 7/08* (2006.01)

(52) U.S. Cl.
CPC ..... *A43C 7/08* (2013.01)

(58) Field of Classification Search
CPC ..... A43C 7/08; A43C 11/165; A43C 7/00; A43C 11/008; Y10T 24/2183
See application file for complete search history.

(56) References Cited

U.S. PATENT DOCUMENTS 9,770,070 B2 9/2017 Cotterman et al.
10,076,160 B2 * 9/2018 Burns ..... A43C 11/165
10,100,975 B2 * 10/2018 Chen ..... F16B 2/08
10,251,451 B2 4/2019 Converse et al.
10,264,852 B2 4/2019 Kim et al.
10,368,613 B2 8/2019 Ha
10,470,525 B2 11/2019 Chen
10,609,988 B2 * 4/2020 Ha ..... A43C 11/20
10,660,404 B2 5/2020 Chen
10,660,407 B2 5/2020 Kawano
2014/0359981 A1 12/2014 Cotterman et al.
2018/0319617 A1 11/2018 Kim
2019/0144150 A1 5/2019 Chen
2019/0150569 A1 5/2019 Chen
2019/0174869 A1 6/2019 Wang et al.
2019/0343235 A1 11/2019 So
2020/0069002 A1 3/2020 Fiedler et al.
2021/0127794 A1 * 5/2021 Chen ..... A43C 11/06
2021/0127795 A1 * 5/2021 Chen ..... A43C 11/06
(Continued)

FOREIGN PATENT DOCUMENTS

CN 102188079 A 9/2011
CN 103224169 A 7/2013
CN 204336002 U 5/2015
(Continued)

*Primary Examiner* — Robert Sandy
*Assistant Examiner* — Louis A Mercado
(74) *Attorney, Agent, or Firm* — CKC & Partners Co., LLC

(57) ABSTRACT

A fastening device including a case unit and a spool is provided. The case unit includes a wall forming a receiving space, an upper opening communicated with the receiving space, and a lower opening opposite to the upper opening and communicated with the receiving space. The spool is within the receiving space. The spool is limited by the wall, and the wall prohibits the spool from leaving the receiving space from the upper opening.

5 Claims, 19 Drawing Sheets

(56) References Cited

U.S. PATENT DOCUMENTS

2021/0289889 A1* 9/2021 Chen ..... A43C 11/08

FOREIGN PATENT DOCUMENTS

| | | | | | |
|---|---|---|---|---|---|
| CN | 205432385 | U | | 8/2016 | |
| DE | 3101952 | A1 | | 9/1982 | |
| EP | 3578069 | B1 | * | 1/2022 | ..... A43C 11/00 |
| JP | 2016-520401 | A | | 7/2016 | |
| JP | 2016-539750 | A | | 12/2016 | |
| KR | 1020160021431 | A | | 2/2016 | |
| KR | 1020170021735 | A | | 2/2017 | |
| KR | 101723579 | B1 | | 4/2017 | |
| KR | 200485472 | Y1 | | 1/2018 | |
| KR | 10-1833680 | B1 | | 2/2018 | |
| TW | 201723344 | A | | 7/2017 | |
| WO | 2015035885 | A1 | | 3/2015 | |
| WO | 2017107724 | A1 | | 6/2017 | |
| WO | 2018086068 | A1 | | 5/2018 | |
| WO | 2018086570 | A1 | | 5/2018 | |
| WO | 2018/101588 | A1 | | 6/2018 | |
| WO | 2018124827 | A1 | | 7/2018 | |

* cited by examiner

FASTENING DEVICE

RELATED APPLICATIONS

This application is a Continuation Application of U.S. application Ser. No. 16/550,274, filed Aug. 25, 2019, now U.S. Pat. No. 11,064,767, which claims priority to Taiwan Application Serial Number 107138414, filed Oct. 30, 2018, and Taiwan Application Serial Number 108123146, filed Jul. 1, 2019, all of which are herein incorporated by reference.

BACKGROUND

Technical Field

The present disclosure relates to a fastening device. More particularly, the present disclosure relates to a fastening device for securing an article through loosening or tightening a lace.

Description of Related Art

In daily life, cords, such as a lace or a thread, are usually used to tighten articles. The most common tightening method is to use the cord to reciprocately pass through holes on the article, e.g., eyelets of a shoe, and then tie a knot to secure the article. But in this kind of tightening method, the knot is loosened easily owing to an external force. Not only does the knot need to be tied again, but also lots of inconveniences come owing to the insecurity of the articles.

In order to solve such problems, some practitioners developed a simple fastening mechanism including a case, an engaging unit and a spring. The case includes holes configured for the lace to pass therethrough. Through the reaction force between the spring and the engaging unit, the lace can be clamped between the engaging unit and the case so as to be fastened. The length of the lace can be changed by pressing the spring to change the position of the engaging unit. However, in such fastening mechanism, the restoring force of the spring is served as the securing force; thus, the lace is easily to be released owing to vibrations or an external force. In addition, the fastening mechanism has no space for receiving the lace, and the exposure of the lace may bring danger.

Therefore, some practitioners developed another kind of buckle which can be rotated to tighten the lace, and the lace can be received inside the buckle. Through the interference between components inside the buckle, the length of the lace as well as the tightness can be adjusted. However, the structure of the buckle is complex; as a result, the manufacturing cost is increased, and the buckle has assembly and repair difficulty.

Based on the above-mentioned problems, how to simplify the structure of the fastening device, reduce the manufacturing cost and maintain the securing capability becomes a pursuit target for practitioners.

SUMMARY

The present disclosure provides a fastening device including a case unit and a spool. The case unit includes a wall forming a receiving space, an upper opening communicated with the receiving space, and a lower opening opposite to the upper opening and communicated with the receiving space. The spool is within the receiving space. The spool is limited by the wall, and the wall prohibits the spool from leaving the receiving space from the upper opening.

The present disclosure provides a fastening device including a case unit, a spool, a knob and an engaging unit. The case unit includes a wall forming a receiving space, an upper opening communicated with the receiving space, and a lower opening opposite to the upper opening and communicated with the receiving space. The spool is within the receiving space. The knob covers the case unit. The engaging unit is within the receiving space and is located above the spool. The engaging unit is coupled to the knob. The spool is limited by the wall, and the wall prohibits the spool from leaving the receiving space from the upper opening. When switch of the knob between a first position and a second position causes movement of the engaging unit along an axial direction, a relative position between the spool and the wall is substantially fixed.

BRIEF DESCRIPTION OF THE DRAWINGS

The disclosure can be more fully understood by reading the following detailed description of the embodiments, with reference made to the accompanying drawings as follows.

DETAILED DESCRIPTION

It will be understood that when an element (or mechanism or module) is referred to as being "disposed on", "connected to" or "coupled to" another element, it can be directly disposed on, connected or coupled to the other one element, or it can be indirectly disposed on, connected or coupled to the other one element, that is, intervening elements may be present. In contrast, when an element is referred to as being "directly disposed on," "directly connected to" or "directly coupled to" another element, there are no intervening elements present.

In addition, the terms first, second, third, etc. are used herein to describe various elements or components, these elements or components should not be limited by these terms. Consequently, a first element or component discussed below could be termed a second element or component.

Figure 1:
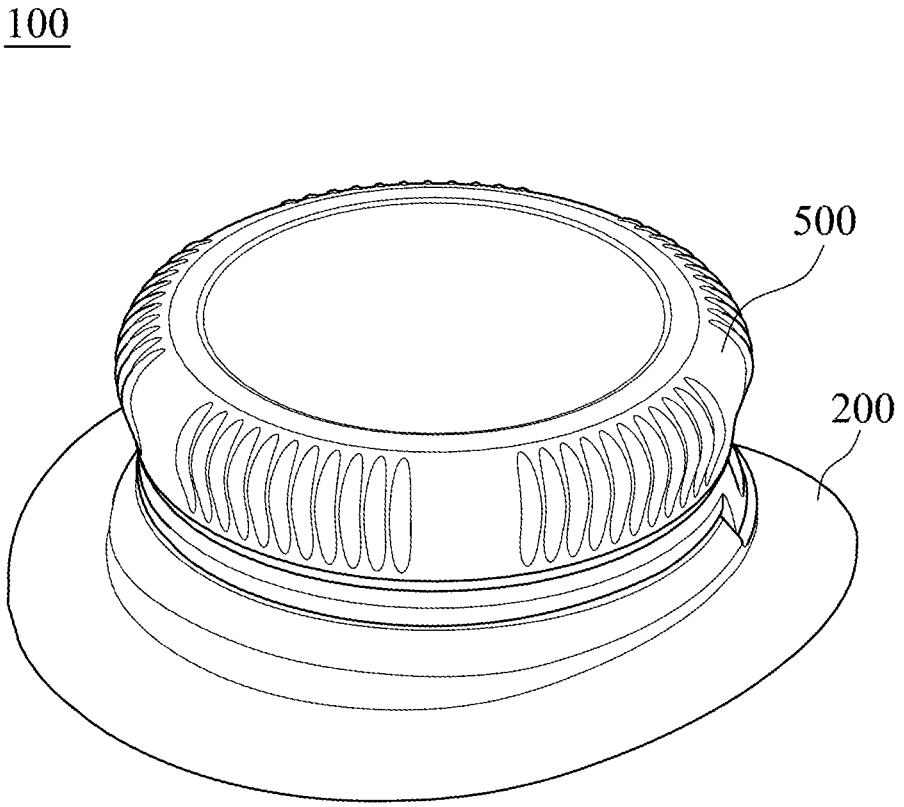
FIG. 1 shows a three dimensional schematic view of a fastening device according to a first embodiment of the present disclosure.
Figure 2:
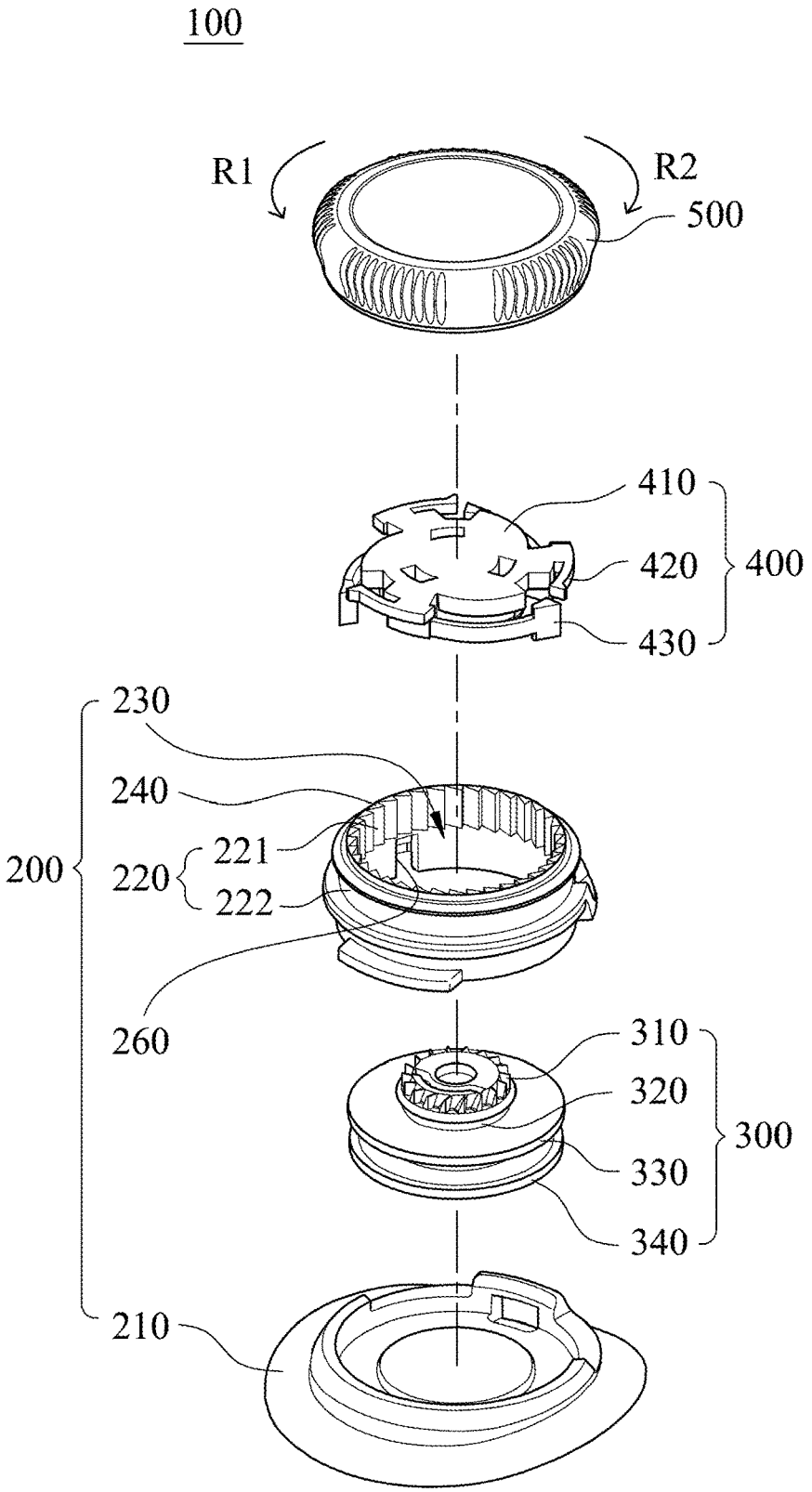
FIG. 2 shows one exploded view of the fastening device of FIG. 1.
Figure 3:
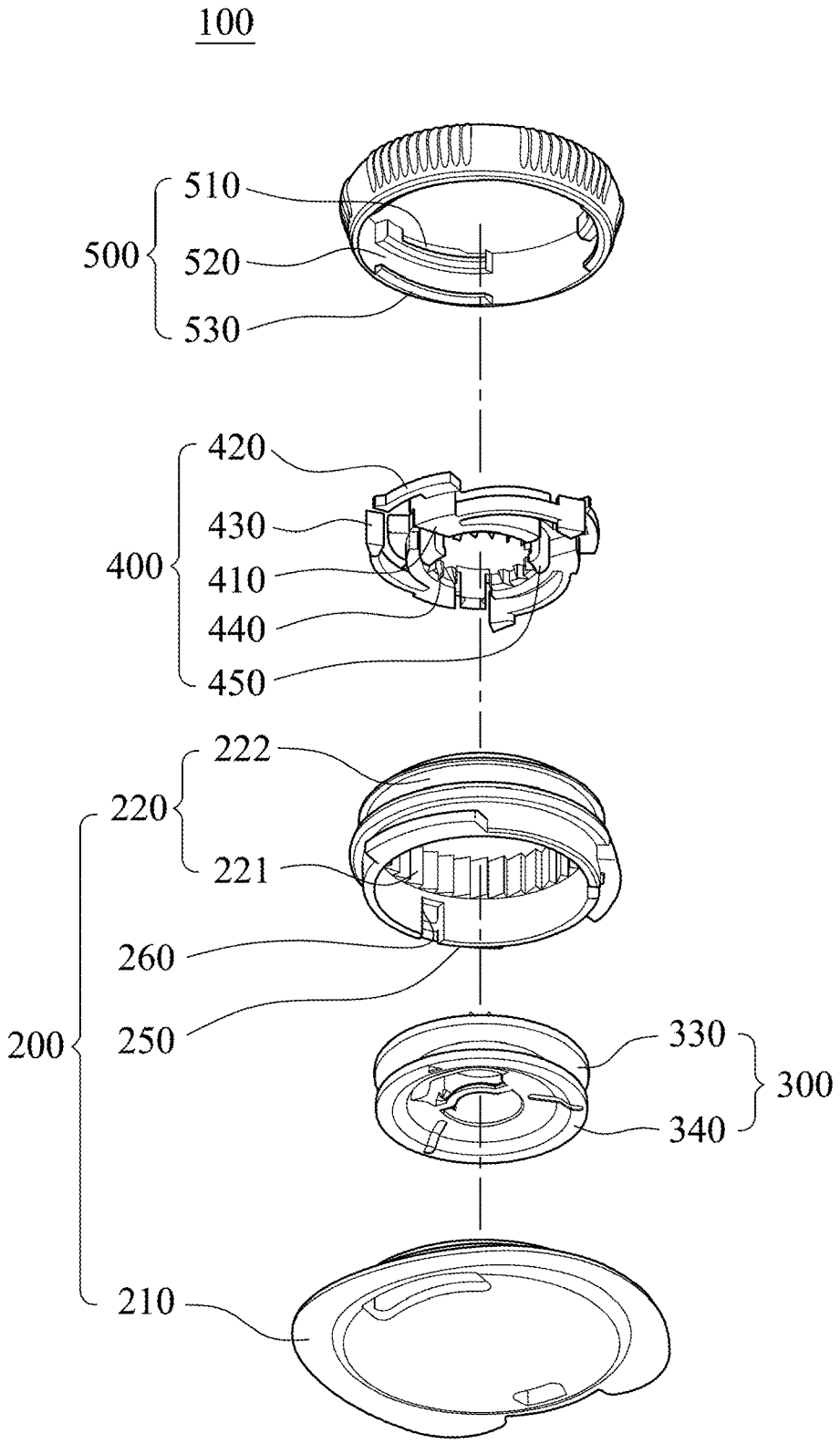
FIG. 3 shows another exploded view of the fastening device of FIG. 1.
Figure 4:
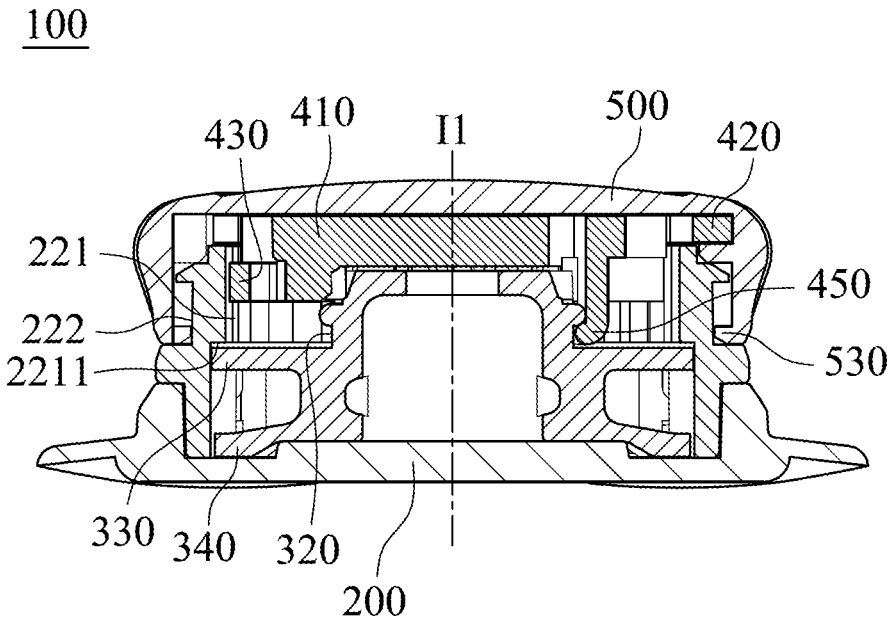
FIG. 4 shows one cross-sectional view of the fastening device of FIG. 1.
Figure 5:
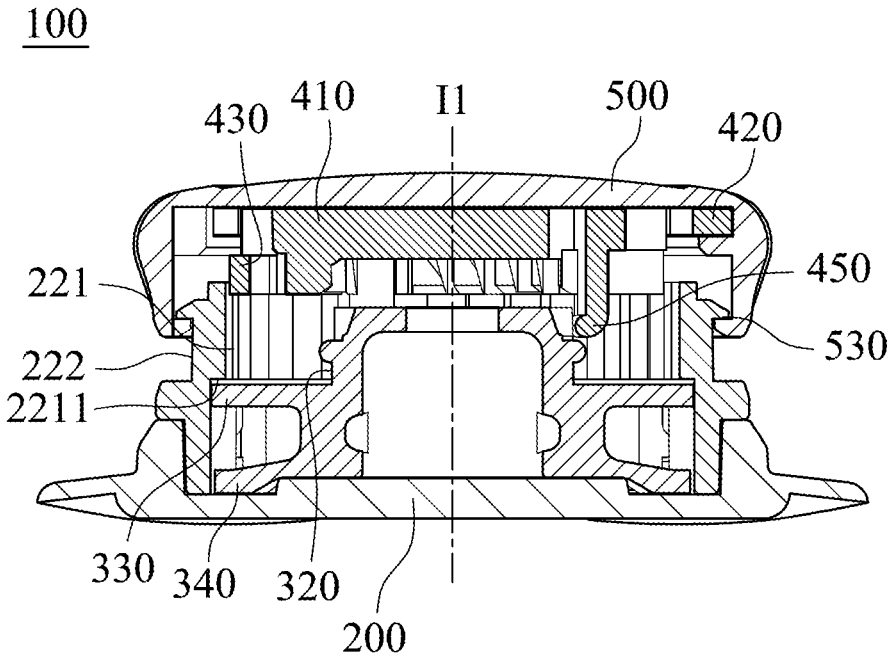
FIG. 5 shows another cross-sectional view of the fastening device of FIG. 1.

FIG. 1 shows a three dimensional schematic view of a fastening device 100 according to a first embodiment of the present disclosure. FIG. 2 shows one exploded view of the fastening device 100 of FIG. 1. FIG. 3 shows another exploded view of the fastening device 100 of FIG. 1. FIG. 4 shows one cross-sectional view of the fastening device 100 of FIG. 1. FIG. 5 shows another cross-sectional view of the fastening device 100 of FIG. 1. The fastening device 100 includes a case unit 200 and a spool 300.

The case unit 200 includes a wall 220 forming a receiving space 230, an upper opening 240 communicated with the receiving space 230, and a lower opening 250 opposite to the upper opening 240 and communicated with the receiving space 230. The spool 300 is within the receiving space 230. The spool 300 is limited by the wall 220, and the wall 220 prohibits the spool 300 from leaving the receiving space 230 from the upper opening 240.

Therefore, the spool 300 is allowed to be put into the case unit 200 from the lower opening 250, and that the spool 300 leaves the receiving space 230 from the upper opening 240 can be prevented. The details of the fastening device 100 will be described in the following paragraphs.

The wall 220 can include a plurality of teeth 221 protruding toward the receiving space 230, and a lower edge 2211 of each of the teeth 221 prohibits the spool 300 from leaving the receiving space 230 from the upper opening 240. Precisely, the wall 220 includes an inner annular surface (not labeled), and the inner annular surface has a uniform diameter. The teeth 221 protrude radially from the inner annular surface; consequently, the diameter of a virtual circle formed by the tips of the teeth 221 will be smaller than the diameter of the inner annular surface.

The spool 300 is hollow ring-shaped and can include an upper ring portion 330 and a lower ring portion 340. A winding track (not labeled) can be formed between the upper ring portion 330 and the lower ring portion 340. In the configuration, a diameter of the upper ring portion 330 is larger than the diameter of the virtual circle formed by the tips of the teeth 221 such that the lower edges 2211 of the teeth 221 can prohibit the spool 300 from leaving from the upper opening 240.

The case unit 200 can further include two lace holes 260 and a base plate 210. The two lace holes 260 are located at the wall 220 and are communicated with the receiving space 230. The lace can go into or go out from the receiving space 230 via the lace holes 260 to be released from or wound about the winding track. The base plate 210 is detachably mounted on the wall 220. When the spool 300 is put into the receiving space 230 via the lower opening 250, the base place 210 can be mounted on the wall 220 to prevent the spool 300 from separating from the case unit 200.

The fastening device 100 can further include a knob 500 and an engaging unit 400. The knob 500 covers the case unit 200. The engaging unit 400 is within the receiving space 230 and is located above the spool 300. The engaging unit 400 is coupled to the knob 500 and includes a first driving portion 440. The spool 300 can include a second driving portion 310 corresponding to the first driving portion 440, and switch of the knob 500 between a first position and a second position causes movement of the engaging unit 400 along an axial direction 11. When the knob 500 is in the first position, the first driving portion 440 is engaged with the second driving portion 310 and the engaging unit 400 corresponds to the teeth 221 such that the engaging unit 400 is engaged with at least one of the teeth 221 to prohibit the spool 300 from rotating in a first direction R1. Rotation of the knob 500 in a second direction R2 opposite to the first direction R1 causes the engaging unit 400 to disengage from the at least one of the teeth 221 such that rotation of the spool 300 in the second direction R2 is allowed, and when the knob 500 is in the second position, the engaging unit 400 does not prohibit the spool 300 from rotating in the first direction R1.

The engaging unit 400 can include a main body 410, three combining arms 420 and three pawl arms 430. The three combining arms 420 disposed at the main body 410 are spaced away from each other, and the three pawl arms 430 disposed at the main body 410 are also spaced away from each other. Each of the three pawl arms 430 is farther from the knob 500 than each of the three combining arms 420 is. Each of the pawl arms 430 has a flexible arc arm structure protruding in the first direction R1, and each of the combining arms 420 has a flexible arc arm structure protruding in the second direction R2. The main body 410 of the engaging unit 400 can include a cave (not shown) located at a bottom thereof. The first driving portion 440, with a form of a tooth, is located within the cave. The second driving portion 310 of the spool 300 is located at the top of the upper ring portion 330 and includes an engaging structure corresponding to the first driving portion 440. When the engaging unit 400 is located above the spool 300 and the knob 500 is located in the first position, the second driving portion 310 protrudes into the cave to couple to the first driving portion 440. On the contrary, when the knob 500 is switched to the second position, the engaging unit 400 moves upward along the axial direction 11 such that the first driving portion 440 is disengaged from the second driving portion 310. In other embodiment, the first driving portion will not be, but not limited to, disengaged from the second driving portion.

The knob 500 can include three mounting grooves 510. The three mounting grooves 510 disposed at an inner surface 520 of the knob 500 are spaced away from each other. The shape of each of the mounting grooves 510 corresponds to the shape of each of the combining arms 420 such that the mounting grooves 510 are configured to assemble to the combining arms 420. Accordingly, the knob 500 is linked up with the engaging unit 400.

The knob 500 can further include three flanges 530. The three flanges 530 disposed at the inner surface 520 of the knob 500 are spaced away from each other. The three flanges 530 are located near a lower end of the inner surface 520. The wall 220 can further include an outer annular groove 222. When the knob 500 covers the wall 220, the three flanges 530 are limited by the outer annular groove 222 to prevent the knob 500 from separating from the wall 220.

In the first embodiment, the fastening device 100 can further include at least one clamping pawl 450 protruding downward, and, as shown in FIG. 3, the fastening device 100 includes three clamping pawls 450 disposed at the main body 410 of the engaging unit 400. The spool 300 can include an engaging portion 320. When the knob 500 is in the first position, the at least one clamping pawl 450 is coupled to the engaging portion 320, and when the knob 500 is in the second position, the at least one clamping pawl 450 is disengaged from the engaging portion 320. The engaging portion 320 has a grooved structure, which is disposed at a top of the upper ring portion 330 and is below the second driving portion 310. The three clamping pawls 450 surround the cave of the engaging unit 400. The clamping pawls 450 are flexible and can be displaced radially after forced. When the knob 500 is pulled up to switch to the second position, the clamping pawls 450 are displaced radially to disengage from the engaging portion 320.

Therefore, as shown in FIG. 4, the knob 500 is in the first position, and the first driving portion 440 of the engaging unit 400 is engaged with the second driving portion 310 of the spool 300. When the knob 500 is rotated in the second direction R2 by the user, the pawl arms 430 will disengage from the teeth 221, and the spool 300 is driven by the engaging unit 400 to retract the lace. On the contrary, when the user releases the knob 500, the pawl arms 430 are engaged with at least one of the teeth 221, rotation of the spool 300 in the first direction R1 is limited by the engaging unit 400 such that the lace is secured.

As shown in FIG. 5, if the user looks forward to release the lace, the knob 500 can be pulled upward along the axial direction 11; meanwhile, the engaging unit 400 also be moved upward such that the first driving portion 440 will disengage from the second driving portion 310. As a result, rotation of the spool 300 will not be limited by the engaging unit 400, and the lace can be released.

Figure 6:
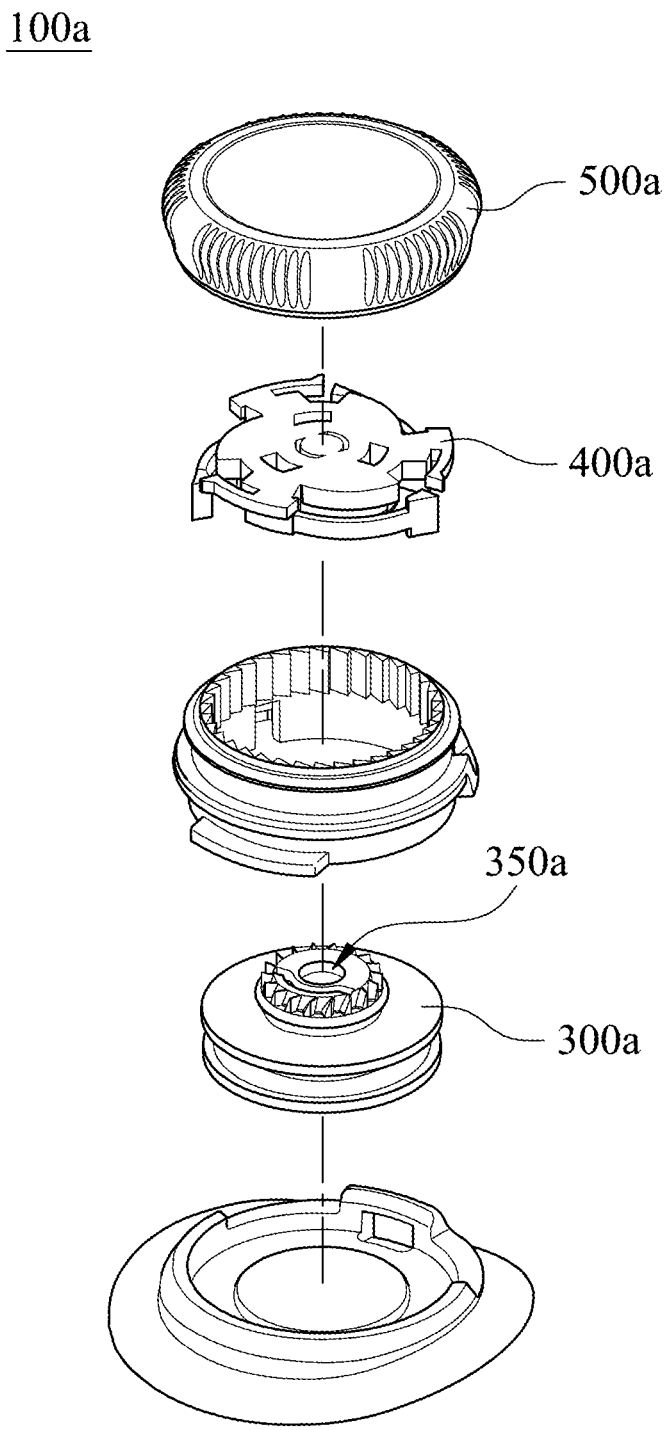
FIG. 6 shows one exploded view of the fastening device according to a second embodiment of the present disclosure.
Figure 7:
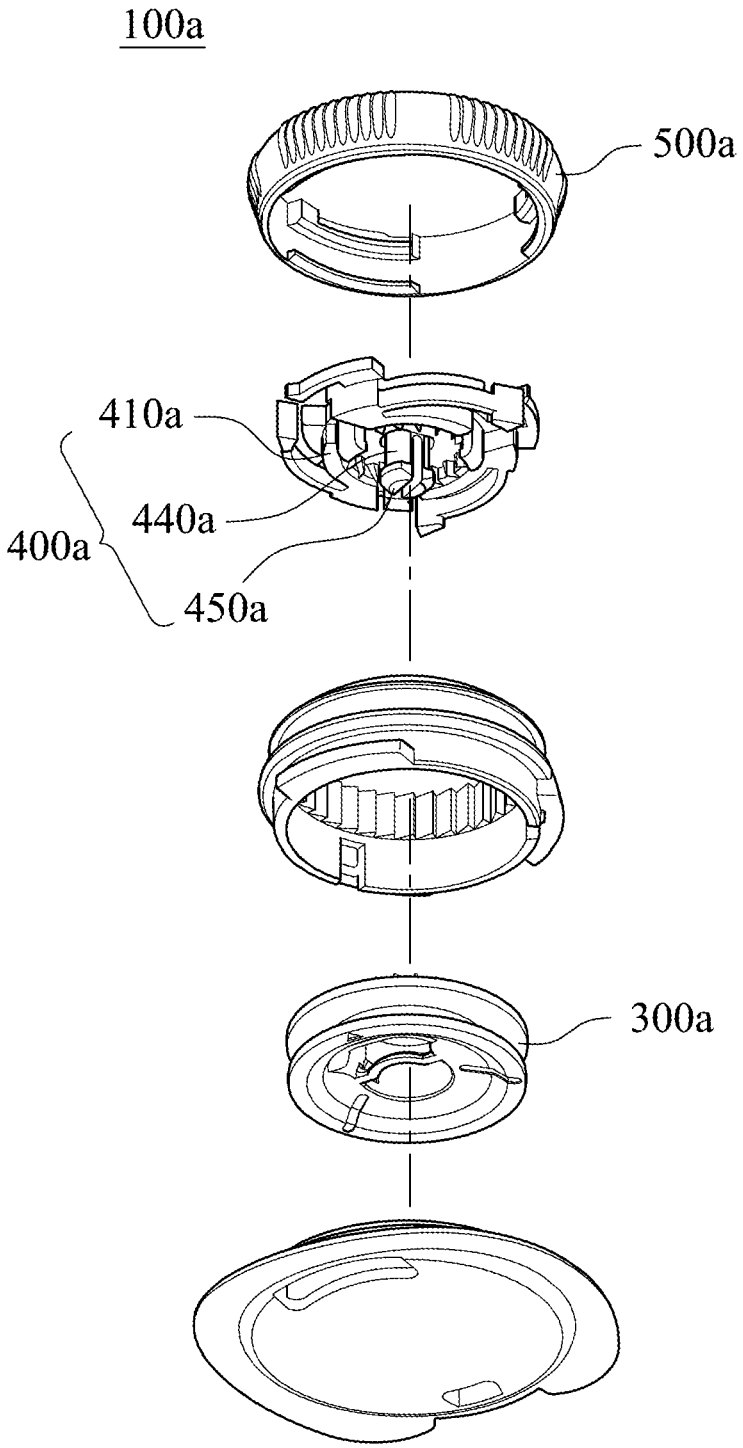
FIG. 7 shows another exploded view of the fastening device of FIG. 6.
Figure 8:
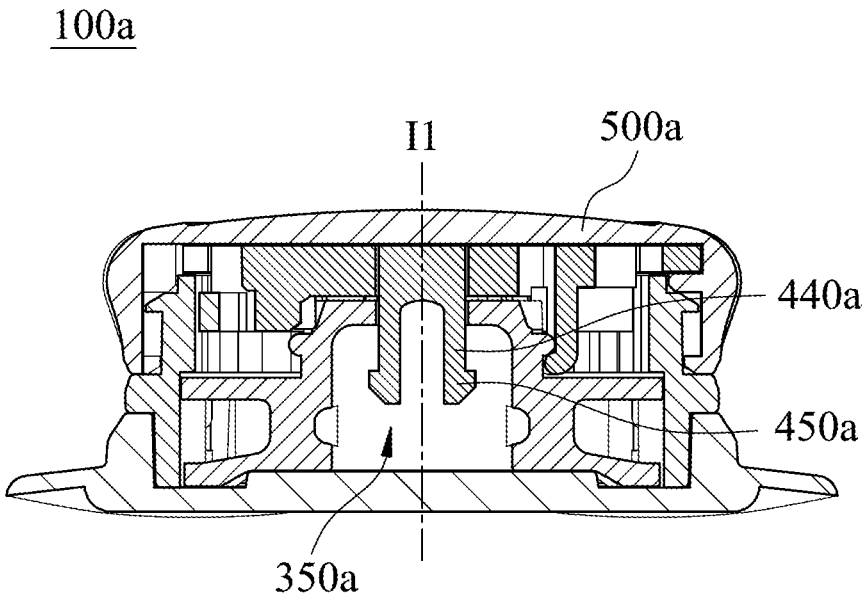
FIG. 8 shows one cross-sectional view of the fastening device of FIG. 6.
Figure 9:
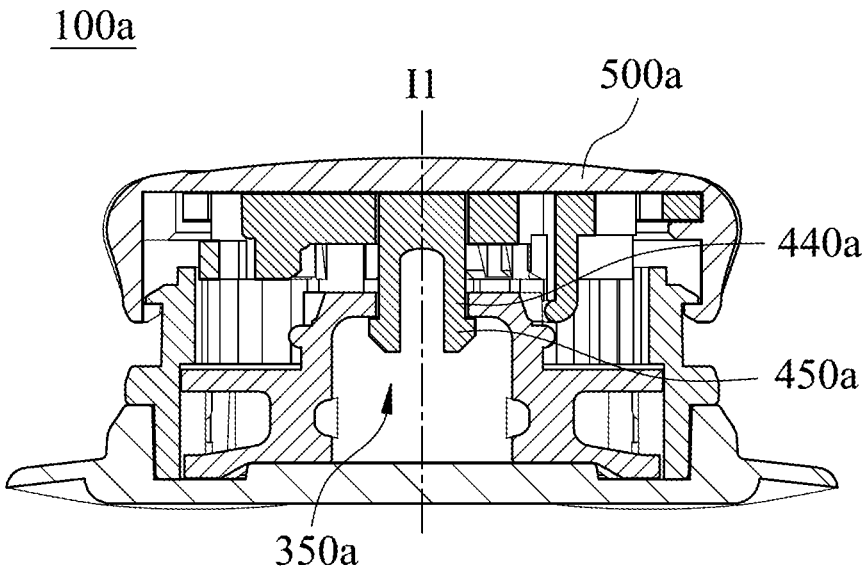
FIG. 9 shows another cross-sectional view of the fastening device of FIG. 6.

FIG. 6 shows one exploded view of the fastening device 100*a* according to a second embodiment of the present disclosure. FIG. 7 shows another exploded view of the fastening device 100*a* of FIG. 6. FIG. 8 shows one cross-sectional view of the fastening device 100*a* of FIG. 6. FIG. 9 shows another cross-sectional view of the fastening device 100*a* of FIG. 6. The structure of the fastening device 100*a* is similar to the structure of the fastening device 100 of the first embodiment, but the structure of the engaging unit 400*a* is different therefrom. The difference between the fastening device 100*a* and the fastening device 100 will be described in the following paragraphs while the similar or the same structure is omitted.

The engaging unit 400*a* includes a main body 410*a*, two arms 440*a* and two limiting protrusions 450*a*. The two arms 440*a* symmetrically disposed at the main body 410*a* protrude downward. Each of the limiting portions 450*a* is located at a distal end of each of the arms 440*a*. The spool 300*a* can include a central through hole 350*a* which is configured for the two arms 440*a* and the two limiting protrusions 450*a* to insert thereinto. When the knob 500*a* is switched between the first position and the second position, the two arms 440*a* will move along the axial direction 11 relative to the central through hole 350*a*, and the two limiting protrusions 450*a* will be limited by the central through hole 350*a*.

The central through hole 350*a* includes a large region (not labeled) and a small region (not labeled). Since the arms 440*a* can be displaced radially after forced, the two arms 440*a* can be inserted downward to pass through the small region and then be restored in the large region when the engaging unit 400*a* is put above the spool 300*a*. Hence, the engaging unit 400*a* can be limited by the spool 300*a*.

Figure 10:
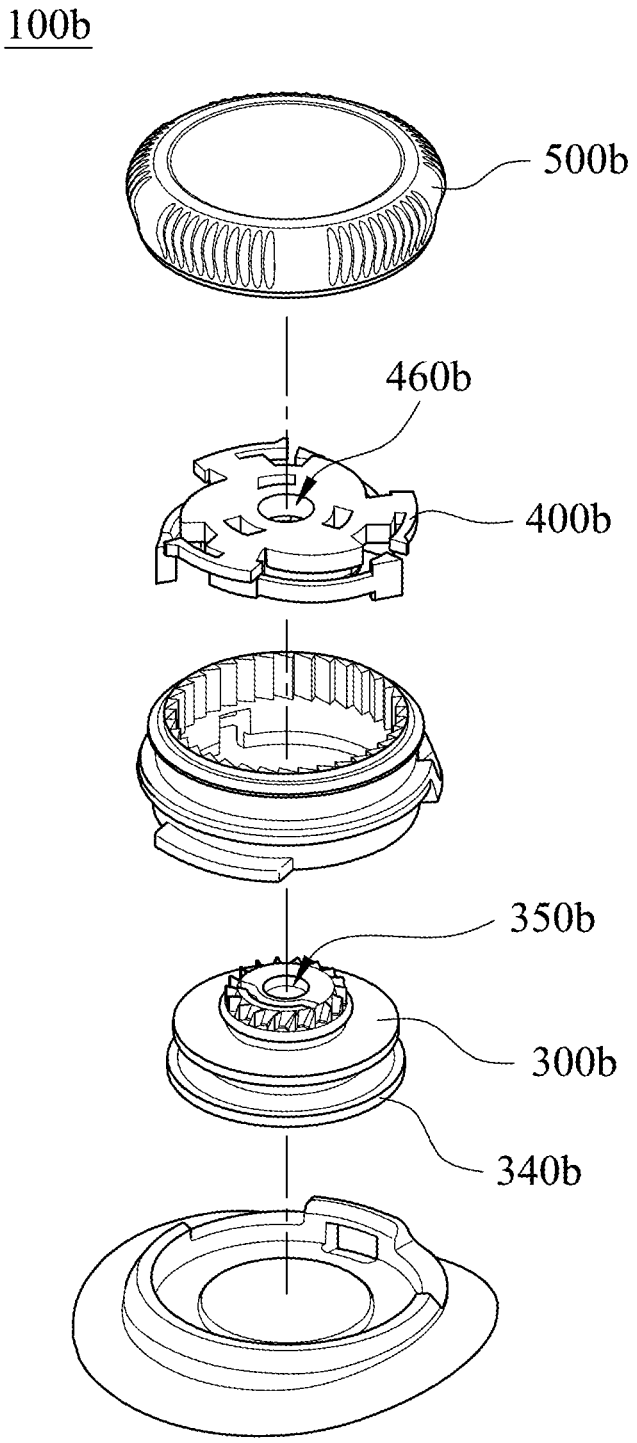
FIG. 10 shows one exploded view of the fastening device according to a third embodiment of the present disclosure.
Figure 11:
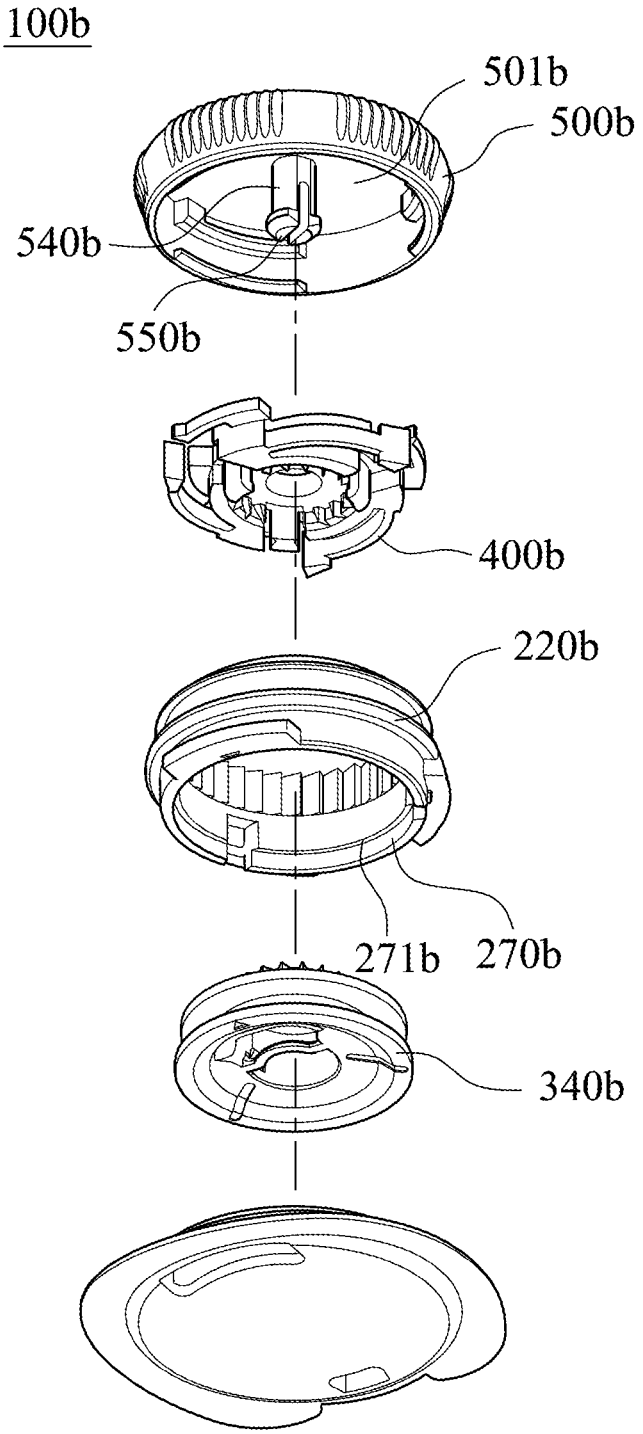
FIG. 11 shows another exploded view of the fastening device of FIG. 10.
Figure 12:
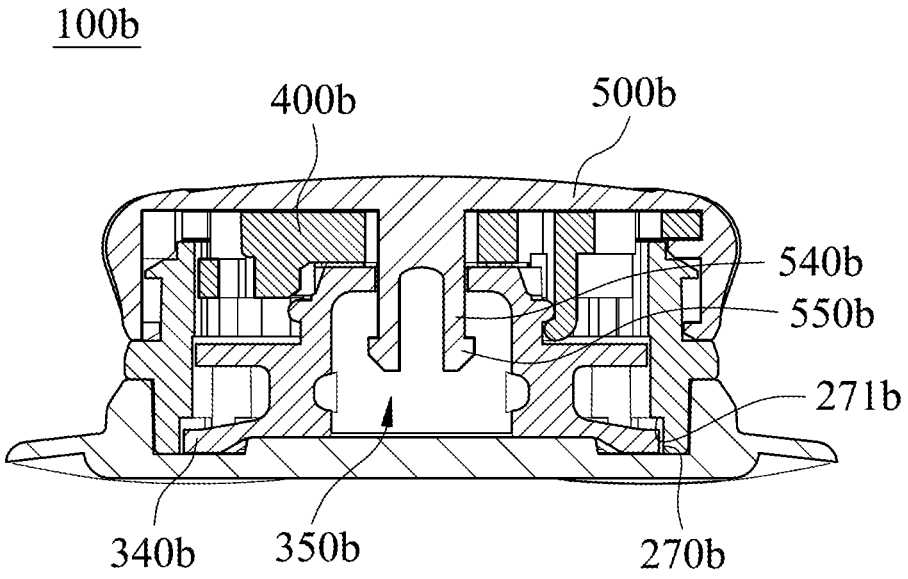
FIG. 12 shows one cross-sectional view of the fastening device of FIG. 10.
Figure 13:
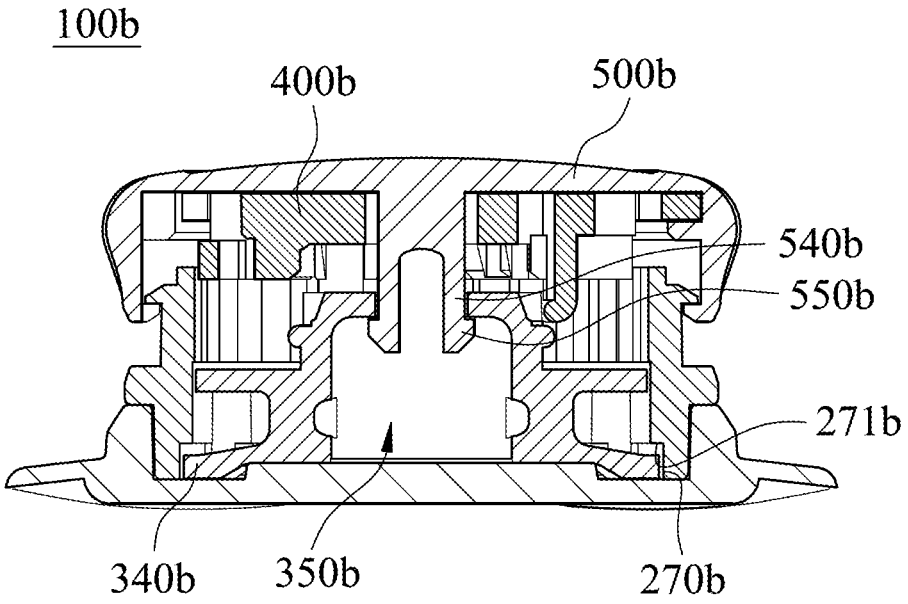
FIG. 13 shows another cross-sectional view of the fastening device of FIG. 10.

FIG. 10 shows one exploded view of the fastening device 100*b* according to a third embodiment of the present disclosure. FIG. 11 shows another exploded view of the fastening device 100*b* of FIG. 10. FIG. 12 shows one cross-sectional view of the fastening device 100*b* of FIG. 10. FIG. 13 shows another cross-sectional view of the fastening device 100*b* of FIG. 10. The structure of the fastening device 100*b* is similar to the structure of the fastening device 100*a* of the second embodiment, but the structures of the knob 500*b*, the engaging unit 400*b* and the wall 220*b* are different therefrom. The difference between the fastening device 100*b* and the fastening device 100*a* will be described in the following paragraphs while the similar or the same structure is omitted.

In the third embodiment, the two arms 540*b* are symmetrically disposed at an inner top 501*b* of the knob 500*b*. Each of the limiting protrusions 550*b* is located at a distal end of each of the arms 540*b*. The engaging unit 400*b* can include a central hole 460*b*. The two arms 540*b* and the two limiting protrusions 550*b* can insert into the central through hole 350*b* after passing through the central hole 460*b* such that the knob 500*b* is limited by the spool 300*b*.

Additionally, the wall 220*b* can include an inner annular groove 270*b*. The inner annular groove 270*b* includes a ring edge 271*b*. The spool 300*b* includes a lower ring portion 340*b*, and the lower ring portion 340*b* is received in the inner annular groove 270*b* such that the ring edge 271*b* prohibits the spool 300*b* from leaving the receiving space (not labeled) from the upper opening (not labeled). In the configuration, the order of the diameters, from large to small in sequentially, are the upper ring portion (not labeled) of the spool 300*b*, the inner annular surface of the wall 220*b*, the lower ring portion 340*b* of the spool 300*b* and the inner annular groove 270*b*. Hence, the spool 300*b* can be put upward into the receiving space, and the lower ring portion 340*b* can be received in the inner annular groove 270*b* such that the spool 300*b* is limited in the receiving space. In other embodiment, the teeth can face toward the receiving space while the lower edge thereof do not limit the spool owing to the configuration of the inner annular groove, but the present disclosure is not limited thereto.

Figure 14:
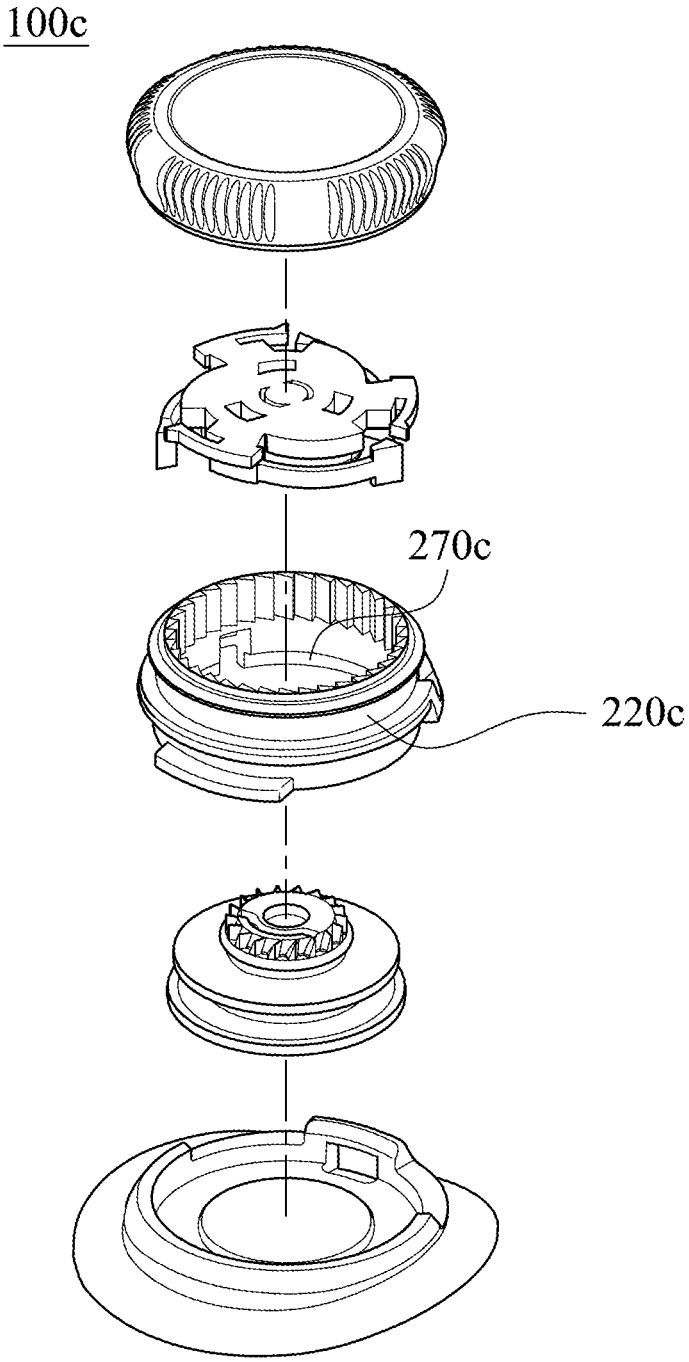
FIG. 14 shows one exploded view of the fastening device according to a fourth embodiment of the present disclosure.
Figure 15:
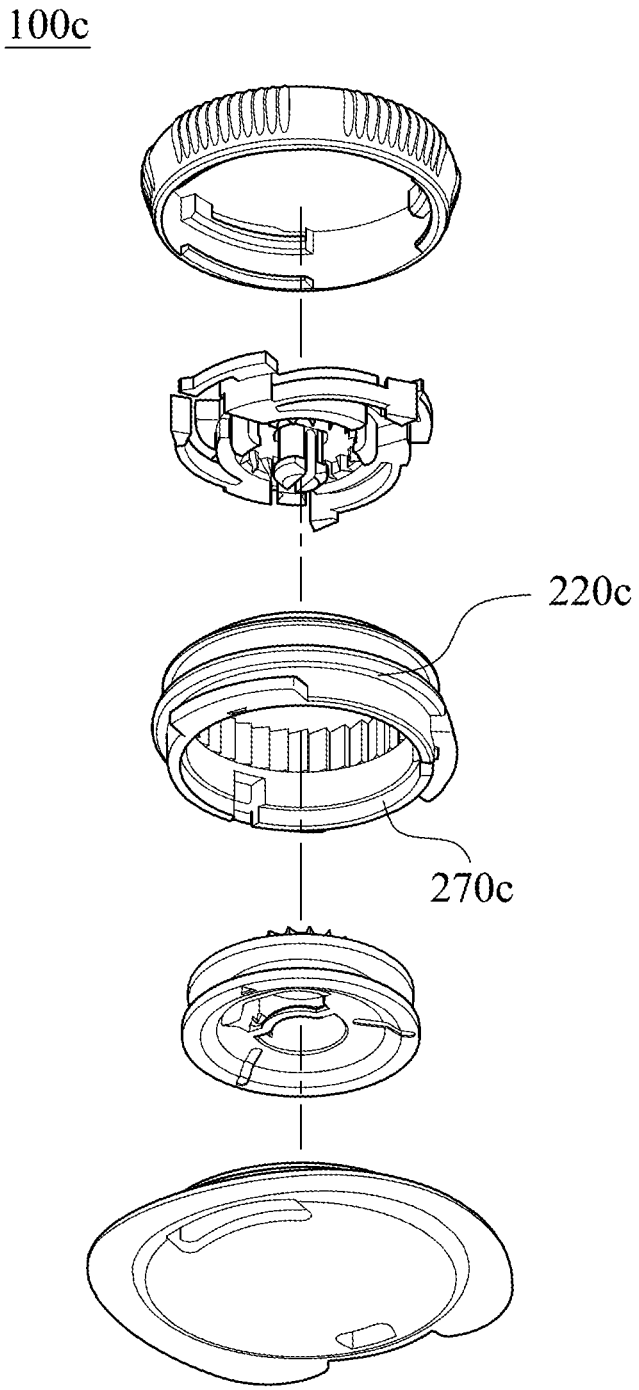
FIG. 15 shows another exploded view of the fastening device of FIG. 14.
Figure 16:
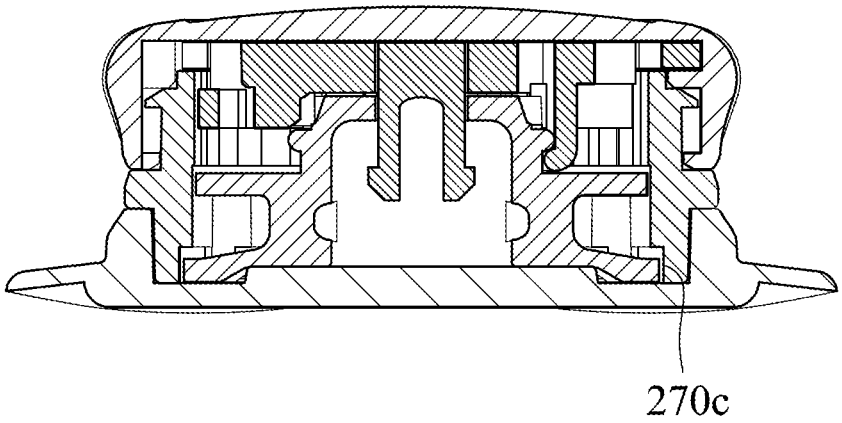
FIG. 16 shows one cross-sectional view of the fastening device of FIG. 14.
Figure 17:
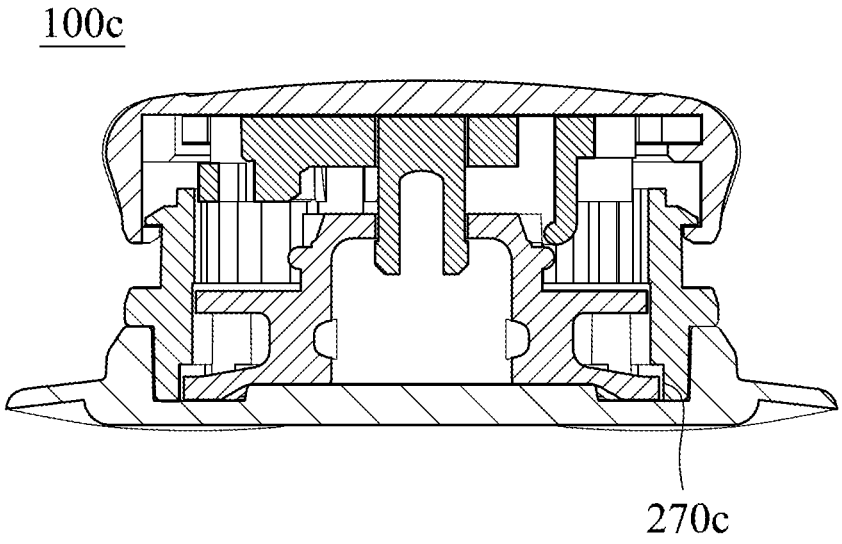
FIG. 17 shows another cross-sectional view of the fastening device of FIG. 14.

FIG. 14 shows one exploded view of the fastening device 100*c* according to a fourth embodiment of the present disclosure. FIG. 15 shows another exploded view of the fastening device 100*c* of FIG. 14. FIG. 16 shows one cross-sectional view of the fastening device 100*c* of FIG. 14. FIG. 17 shows another cross-sectional view of the fastening device 100*c* of FIG. 14. The structure of the fastening device 100*c* is similar to the structure of the fastening device 100*a* of the second embodiment, but the structure of the wall 220*c* is different therefrom. To be more specific, the wall 220*c* can include the inner annular groove 270*c*, and the structure of the inner annular groove 270*c* is the same as the structure of the inner annular groove 270*b* of the third embodiment. The details will not be described hereafter.

Figure 18:
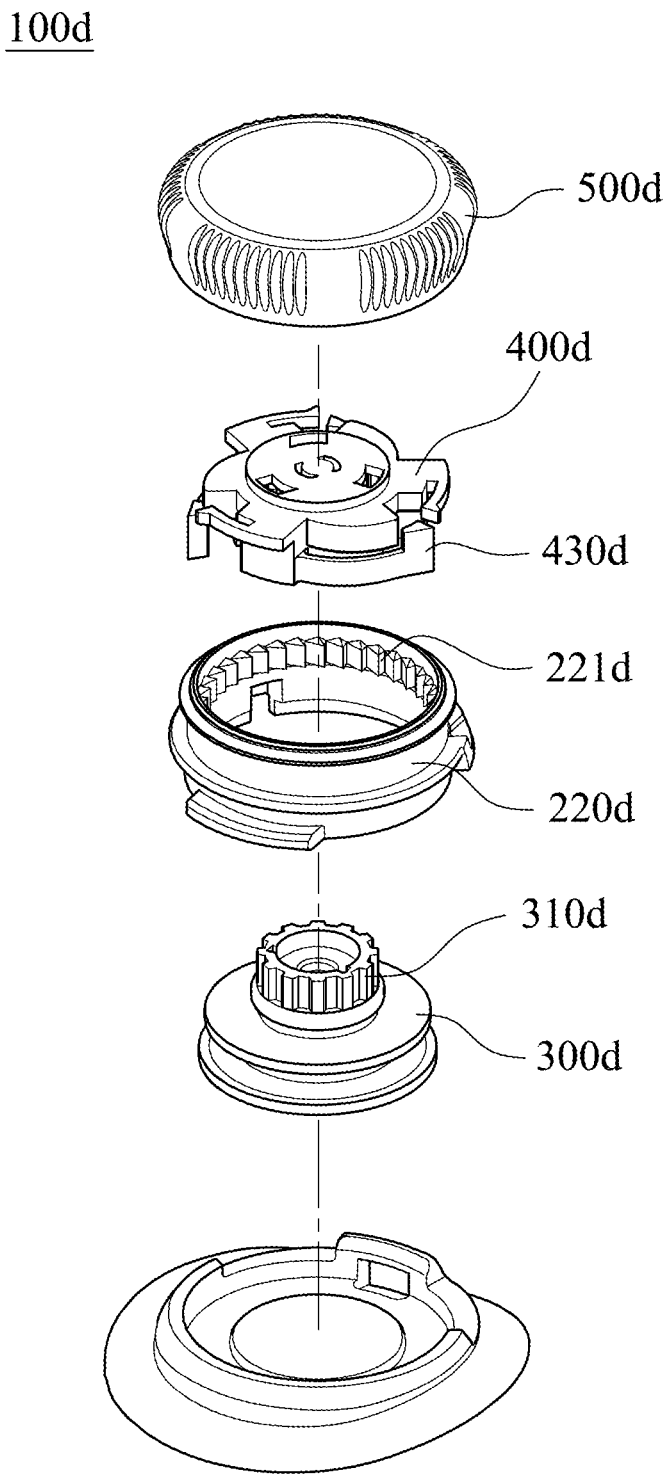
FIG. 18 shows one exploded view of the fastening device according to a fifth embodiment of the present disclosure.
Figure 19:
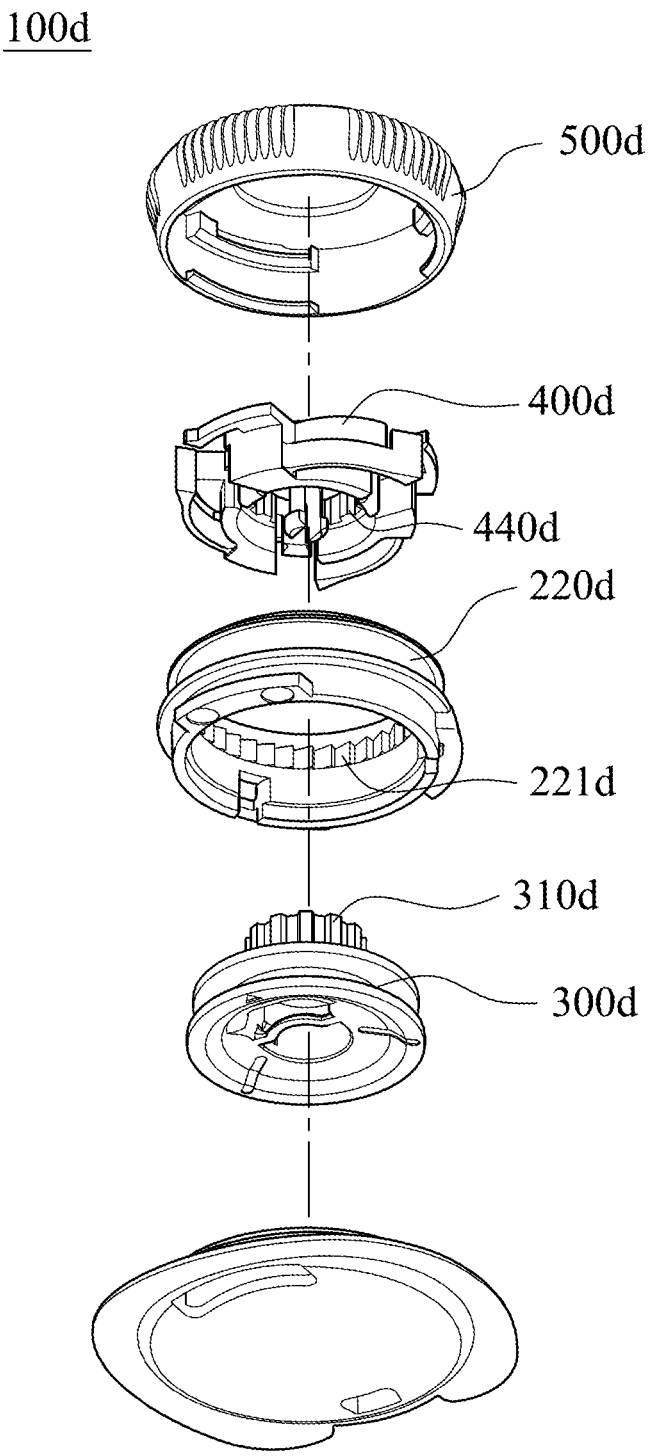
FIG. 19 shows another exploded view of the fastening device of FIG. 18.
Figure 20:
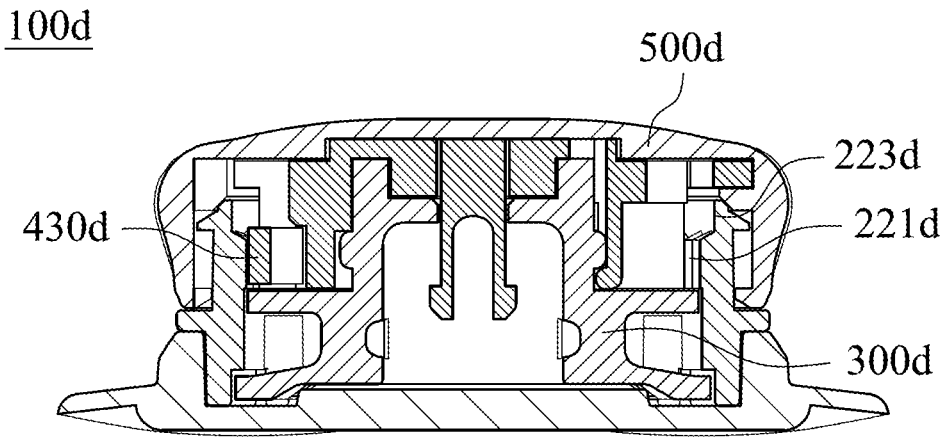
FIG. 20 shows one cross-sectional view of the fastening device of FIG. 18.
Figure 21:
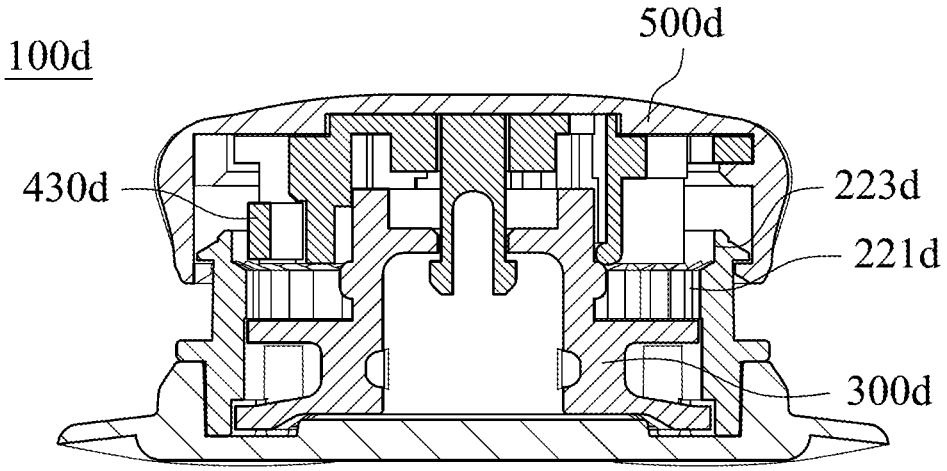
FIG. 21 shows another cross-sectional view of the fastening device of FIG. 18.

FIG. 18 shows one exploded view of the fastening device 100*d* according to a fifth embodiment of the present disclosure. FIG. 19 shows another exploded view of the fastening device 100*d* of FIG. 18. FIG. 20 shows one cross-sectional view of the fastening device 100*d* of FIG. 18. FIG. 21 shows another cross-sectional view of the fastening device 100*d* of FIG. 18. The structure of the fastening device 100*d* is similar to the structure of the fastening device 100*c* of the fourth embodiment, but the detail structures are different therefrom.

To be more specific, the wall 220*d* can further include an upper annular groove 223*d* located above the teeth 221*d*. When the knob 500*d* is in the first position, the pawl arms 430*d* of the engaging unit 400*d* correspond to the teeth 221*d*, and the first driving portion 440*d* is coupled to the second driving portion 310*d* of the spool 300*d*. When the knob 500*d* is in the second position, the pawl arms 430*d* correspond to the upper annular groove 223*d* and are completely disengaged from the teeth 221*d* while the first driving portion 440*d* is coupled to the second driving portion 310*d*.

Figure 22:
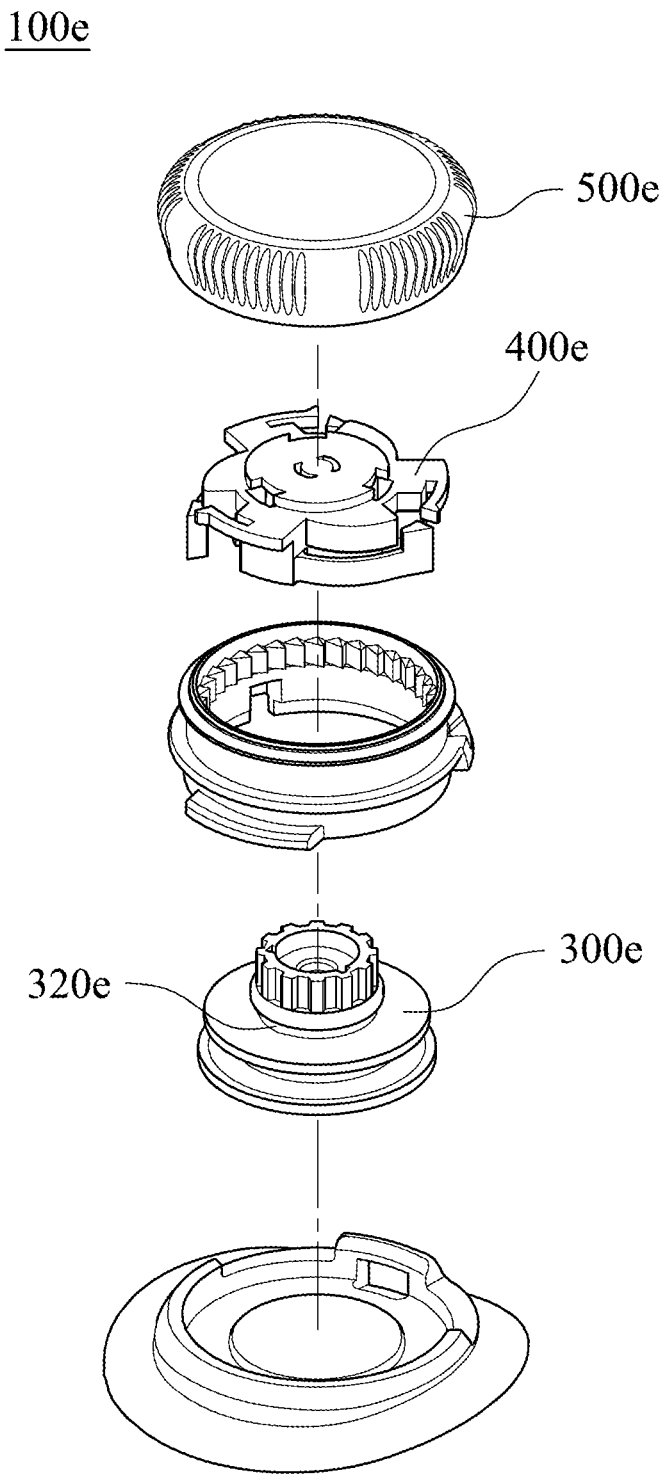
FIG. 22 shows one exploded view of the fastening device according to a sixth embodiment of the present disclosure.
Figure 23:
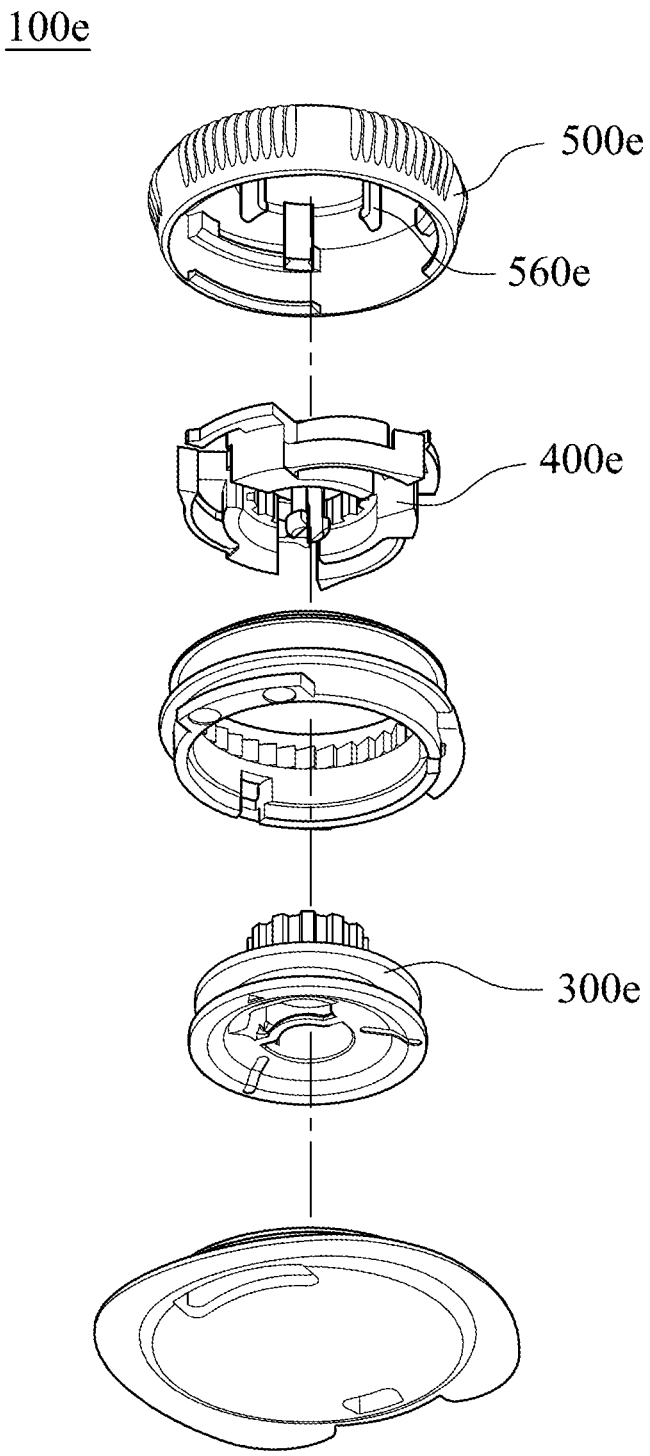
FIG. 23 shows another exploded view of the fastening device of FIG. 22.
Figure 24:
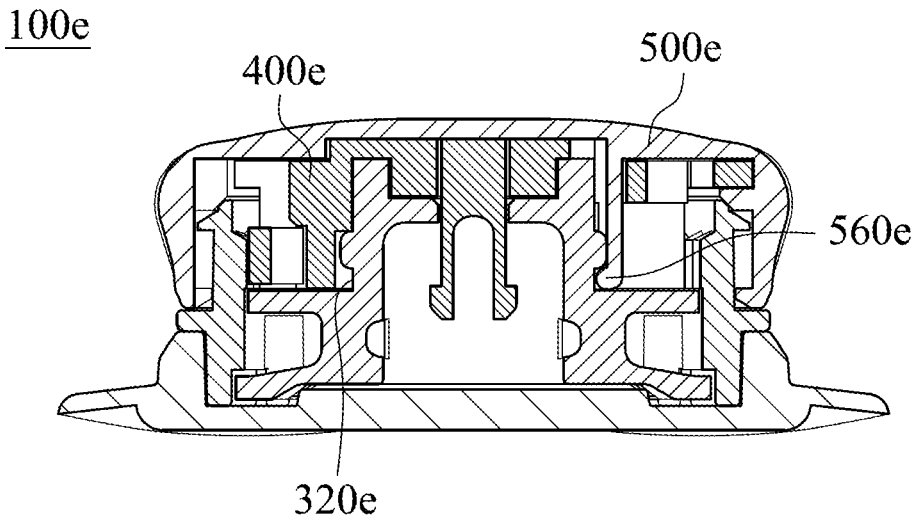
FIG. 24 shows one cross-sectional view of the fastening device of FIG. 22.
Figure 25:
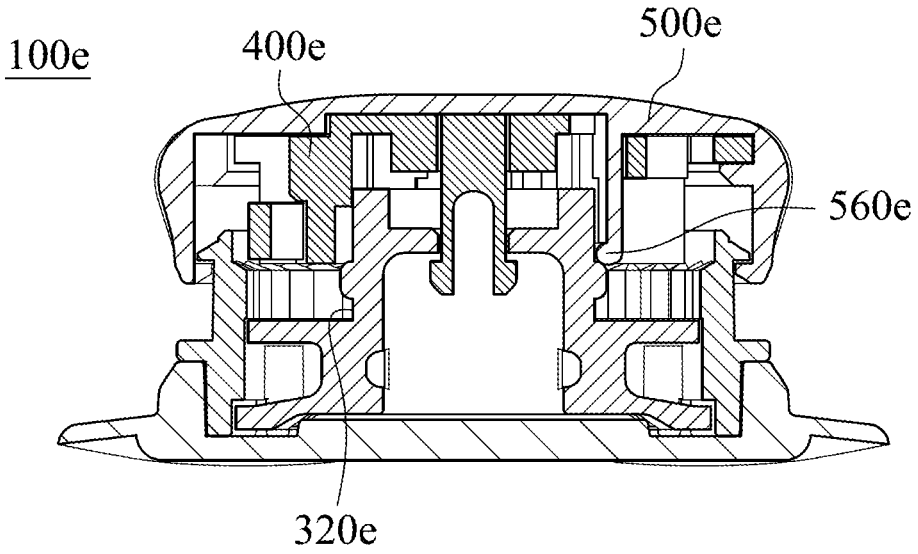
FIG. 25 shows another cross-sectional view of the fastening device of FIG. 22.

FIG. 22 shows one exploded view of the fastening device 100*e* according to a sixth embodiment of the present disclosure. FIG. 23 shows another exploded view of the fastening device 100*e* of FIG. 22. FIG. 24 shows one cross-sectional view of the fastening device 100*e* of FIG. 22. FIG. 25 shows another cross-sectional view of the fastening device 100*e* of FIG. 22. The structure of the fastening device 100*e* is similar to the structure of the fastening device 100*d* of the fifth embodiment, but the structures of the engaging unit 400*e* and the knob 500*e* are different therefrom. The difference between the fastening device 100*e* and the fastening device 100*d* will be described in the following paragraphs while the similar or the same structure is omitted.

In the sixth embodiment, the fastening device 100*e* can further include at least one clamping pawl 560*e* protruding downward, and, as shown in FIG. 23, the fastening device 100*e* includes three clamping pawls 560*e* disposed at an inner top of the knob 500*e*. The engaging unit 400*e* includes no clamping pawls. The spool 300*e* can include an engaging portion 320*e*. When the knob 500*e* is in the first position, the clamping pawls 560*e* are coupled to the engaging portion 320*e* of the spool 300*e*, and when the knob 500*e* is in the second position, the clamping pawls 560*e* are disengaged from the engaging portion 320*e*.

As abovementioned embodiments, the two arms of the fastening device can be symmetrically disposed at the main body of the engaging unit or the inner top of the knob, and the at least one clamping pawl can be disposed at the main body of the engaging unit or the inner top of the knob to selectively couple to the engaging portion of the spool.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. A fastening device, comprising:

a case unit, comprising:

a wall forming a receiving space and comprising a plurality of teeth;

an upper opening communicated with the receiving space; and a lower opening opposite to the upper opening and communicated with the receiving space; and a spool within the receiving space comprising an upper ring portion;

wherein, except for the teeth, a maximum inner diameter of the wall is substantially larger than a maximum outer diameter of the upper ring portion, the spool is configured to be put into the receiving space, and when the spool is moved upward, a lower edge of each of the teeth contacts the upper ring portion of the spool to prohibit the spool from leaving the receiving space from the upper opening.

2. The fastening device of claim 1, further comprising:

a knob covering the case unit; and an engaging unit within the receiving space, the engaging unit coupled to the knob and comprising a first driving portion;

wherein the spool comprises a second driving portion corresponding to the first driving portion, an operation of the knob causes movement of the engaging unit along an axial direction, when the engaging unit is in a low position, the first driving portion is engaged with the second driving portion and the engaging unit corresponds to the teeth such that the engaging unit is engaged with at least one of the teeth to prohibit the spool from rotating in a first direction, rotation of the knob in a second direction opposite to the first direction causes the engaging unit to disengage from the at least one of the teeth such that rotation of the spool in the second direction is allowed.

3. The fastening device of claim 2, wherein when the knob is pulled upward from a first position to a second position, the engaging unit is allowed to switch from the low position to a high position, and when the engaging unit is in the high position, the engaging unit does not prohibit the spool from rotating in the first direction.

4. The fastening device of claim 3, further comprising at least one clamping pawl protruding downward, wherein the at least one clamping pawl is disposed at a main body of the engaging unit or an inner top of the knob, the spool further comprises an engaging portion, when the knob is in the first position, the at least one clamping pawl is coupled to the engaging portion, and when the knob is in the second position, the at least one clamping pawl is disengaged from the engaging portion.

5. The fastening device of claim 3, further comprising two arms and two limiting protrusions, wherein the two arms are symmetrically disposed at a main body of the engaging unit or an inner top of the knob, the two arms protrude downward, each of the limiting protrusions is located at a distal end of each of the arms, the spool further comprises a central through hole, the central through hole is configured for the two arms and the two limiting protrusions to insert therethrough, and when the knob is switched between the first position and the second position, the two arms move along the axial direction toward the central through hole, and the two limiting protrusions are limited by the central through hole.

* * * * *